US007036496B2

(12) United States Patent
Janavicius

(10) Patent No.: US 7,036,496 B2
(45) Date of Patent: May 2, 2006

(54) ANTI-CLOGGING PAINTBALL FIRING MECHANISM

(75) Inventor: Jason P. Janavicius, San Diego, CA (US)

(73) Assignee: JT USA, LLC, Chula Vista, CA (US)

( * ) Notice: Subject to any disclaimer, the term of this patent is extended or adjusted under 35 U.S.C. 154(b) by 100 days.

(21) Appl. No.: 10/722,037

(22) Filed: Nov. 24, 2003

(65) Prior Publication Data

US 2005/0109329 A1 May 26, 2005

(51) Int. Cl.
*F41B 11/26* (2006.01)

(52) U.S. Cl. ..... 124/71

(58) Field of Classification Search ..... 124/71–77
See application file for complete search history.

(56) References Cited

U.S. PATENT DOCUMENTS

| | | | | |
|---|---|---|---|---|
| 6,553,983 | B1 * | 4/2003 | Li | 124/73 |
| 6,557,542 | B1 * | 5/2003 | Orr | 124/70 |
| 6,820,606 | B1 * | 11/2004 | Duffey | 124/31 |
| 2002/0170551 | A1 * | 11/2002 | Kotsiopoulos et al. | 124/54 |
| 2003/0047175 | A1 * | 3/2003 | Farrell | 124/76 |
| 2004/0144377 | A1 * | 7/2004 | Dobbins | 124/74 |
| 2004/0237954 | A1 * | 12/2004 | Styles et al. | 124/77 |
| 2005/0028802 | A1 * | 2/2005 | Jones | 124/73 |

* cited by examiner

*Primary Examiner*—Troy Chambers
(74) *Attorney, Agent, or Firm*—Keisling Pieper & Scott PLC; David B. Pieper; Trent C. Keisling

(57) ABSTRACT

A mechanism for preventing the chopping by the firing bolt of a paintball stuck or only partially inserted into the gun barrel. The bolt comprises an axial channel admitting compressed gas through a radial intake port in the proximal section of the bolt and leading the gas through a elbow-zone and an axial portion to a discharge port at the leading edge of the bolt. A sleeve slidingly engaged over the bolt as a radial aperture which is maintained in line with the intake port by a compressible coil spring, and has a leading portion extending ahead of the bolt. When the firing mechanism translates the bolt and sleeve to place the intake port and aperture in line with a gas-supplying outlet, any obstruction in the gun barrel upon being contacted by the leading edge of the sleeve, causes the sleeve to resiliently slide backward. The misalignment of the aperture and intake port prevents gas from expanding through the bolt channel and into the gun barrel. In the absence of any obstruction in the gun barrel, the expansion of the gas against the elbow-zone of the bolt channel exerts backward pressure on the bolts facilitating its recoiling toward the next firing position.

10 Claims, 3 Drawing Sheets

ANTI-CLOGGING PAINTBALL FIRING MECHANISM

FIELD OF THE INVENTION

This invention relates to compressed gas firing mechanisms and more specifically to firing mechanisms used in connection with paintball guns.

BACKGROUND OF THE INVENTION

In a paintball gun, projectiles are admitted into a gun barrel from a magazine through a radial hole in the upper region of the barrel. Compressed air is then delivered between the breech of the gun and the projectile, and the expansion of the gas propels the paintball down the gun barrel. The alternate opening of the paintball entry port and the gas admitting port is controlled by a bolt assembly that, in a recoiled position, allows a paintball to drop into the gun barrel and in a firing position move that paintball forward and closes the paintball admitting port while at the same time opening the gas delivery port. The envelope of a paintball is commonly made of soft, pliable material that can be easily torn. When a paintball is jammed into the gun barrel or is only partially passed through the paintball admitting port, the bolt tends to chop or crush the paintball smearing viscous paint inside the firing mechanism and rendering the gun inoperable until it has been thoroughly cleaned.

The prior art had produced some anti-chopping bolt assemblies that are built within the bolt and require actuation through some radially moving parts. The complexity of the anti-chopping and crushing mechanism of the prior art tends to reduce gun reliability. Moreover, the axial unbalance of the mechanism tends to increase wear and affect the life of the gun.

This invention results from an attempt to devise a simple, reliable and balanced mechanism for avoiding chopping or crushing a jammed paintball.

SUMMARY OF THE INVENTION

The principal and secondary objects of this invention are to provide a simple, reliable and balanced mechanism for preventing discharge of compressed gas into a gun barrel behind a projectile that is jammed and to prevent the chopping or crushing of that projectile by the firing mechanism bolt, while at the same time facilitating and speeding the automatic recoiling of the bolt in order to create a more rapid and smoother automatic firing sequence.

These and other objects of this invention are achieved by using a bolt having an internal channel starting at a radial port in the proximal part of the bolt and going through a 90 degree elbow into an axial channel leading to a discharge port at the distal, leading edge of the bolt. A sleeve slidingly engaged over the bolt has a radial aperture which is resiliently biased in line with the entrance port of the bolt but can slide rearwardly against a spring so that the aperture is no longer in line with the bolt channel port when its leading edge contacts a jammed projectile. The pressure imparted against the elbowed section of the bolt channel by the expanding gas accelerates the recoil of the bolt and sleeve mechanism to allow faster multi-firing sequences.

DESCRIPTION OF THE PREFERRED EMBODIMENT OF THE INVENTION

The preferred embodiment of the invention is described in connection with a paintball firing mechanism. It should be understood that the invention is equally applicable to other types of compressed gas firing systems.

Figure 1:
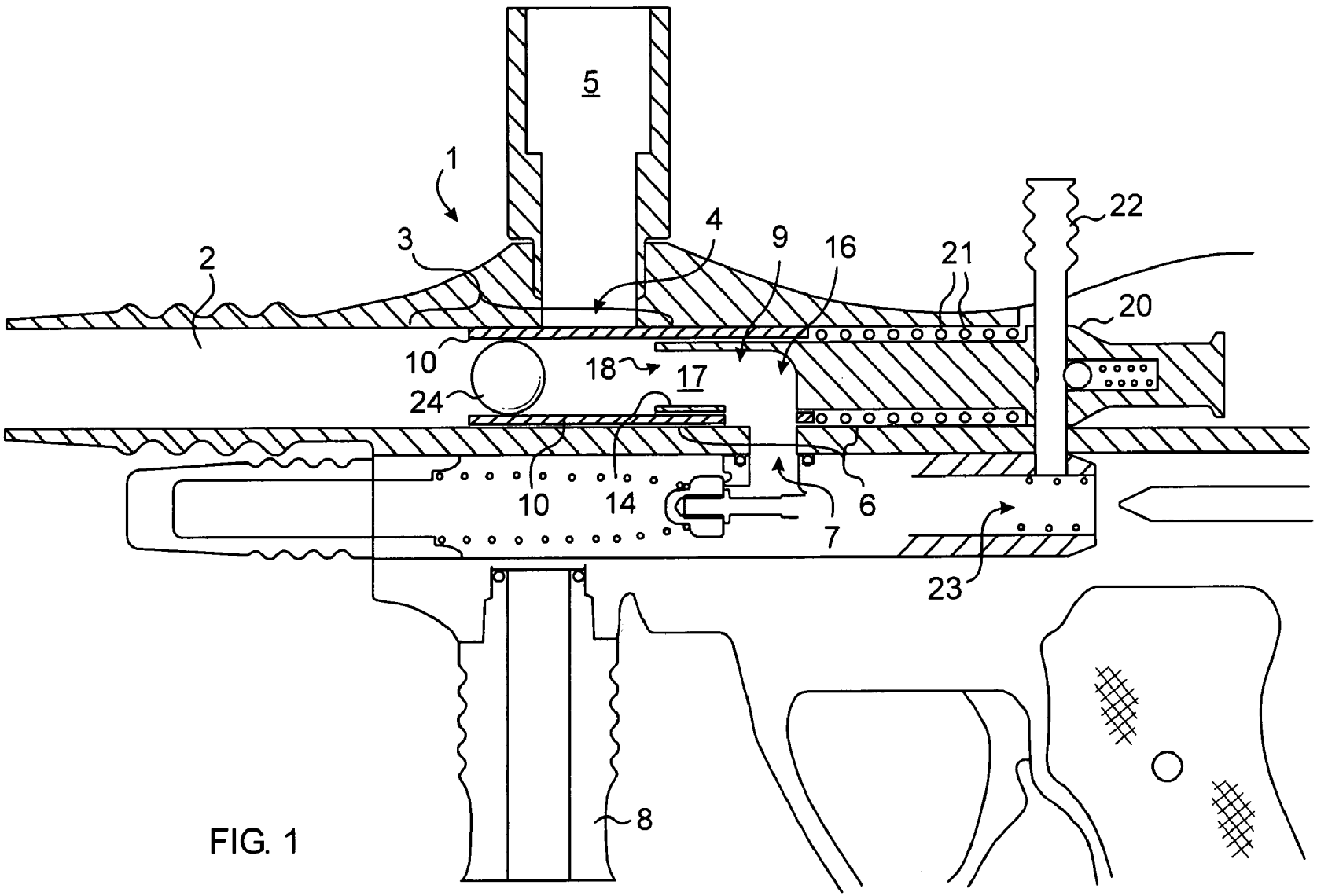
FIG. 1 is a side view of the paintball firing mechanism.

Referring now to FIG. 1, there is shown the firing mechanism 1 of a paintball gun in the firing position. The mechanism comprises a gun barrel 2 of which a first portion 3 has a radial first port 4 admitting paintballs from an inlet 5 connected to a paintball magazine not shown on the drawing.

In a second portion 6 of the gun barrel located rearwardly from the first portion, a second radial port 7 admits compressed gas fed from source 8 such as a a gas cartridge. A bolt assembly 9 is translated axially across the first and second portions of the gun barrel to alternately control the admission of paintballs through the first port or the admission of compressed gas through the second port.

Figure 2:
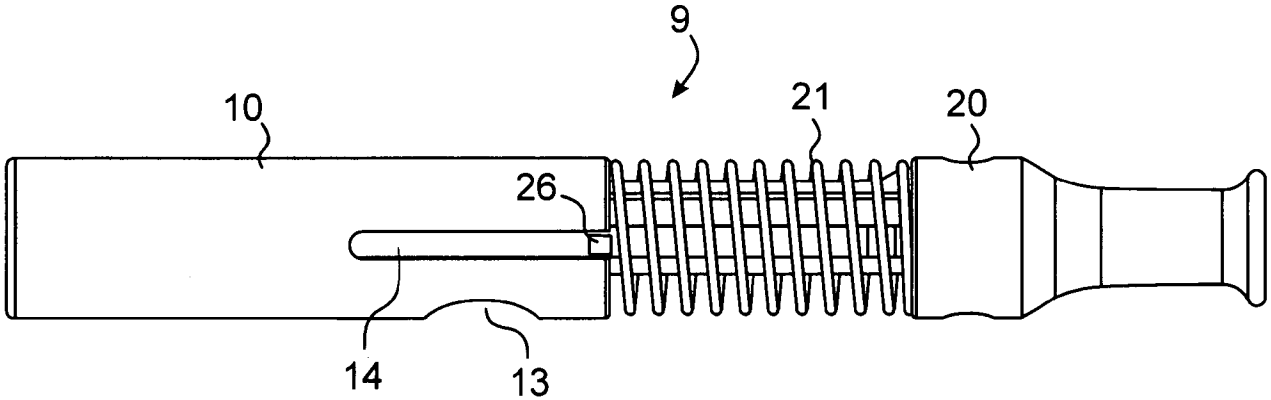
FIG. 2 is a side view of the sleeve and bolt assembly in its fully extended mode.
Figure 3:
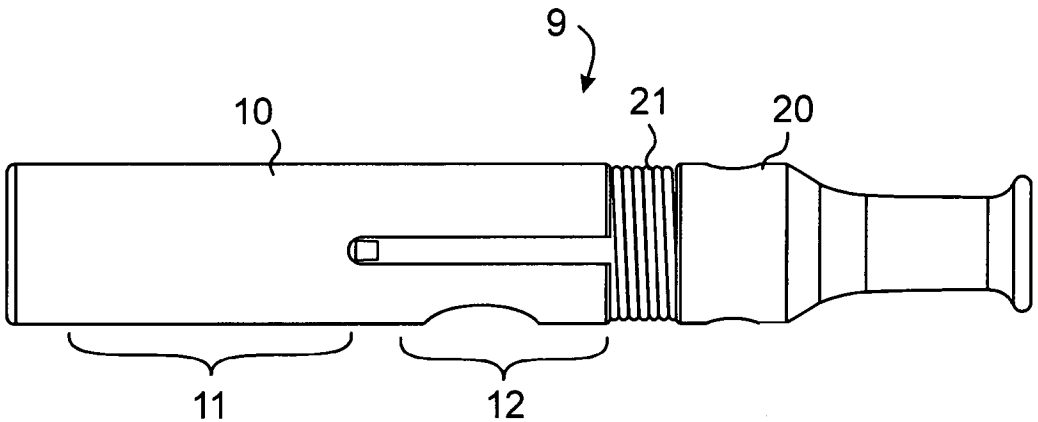
FIG. 3 is a side view of the sleeve and bolt assembly in the compressed mode.
Figure 4:
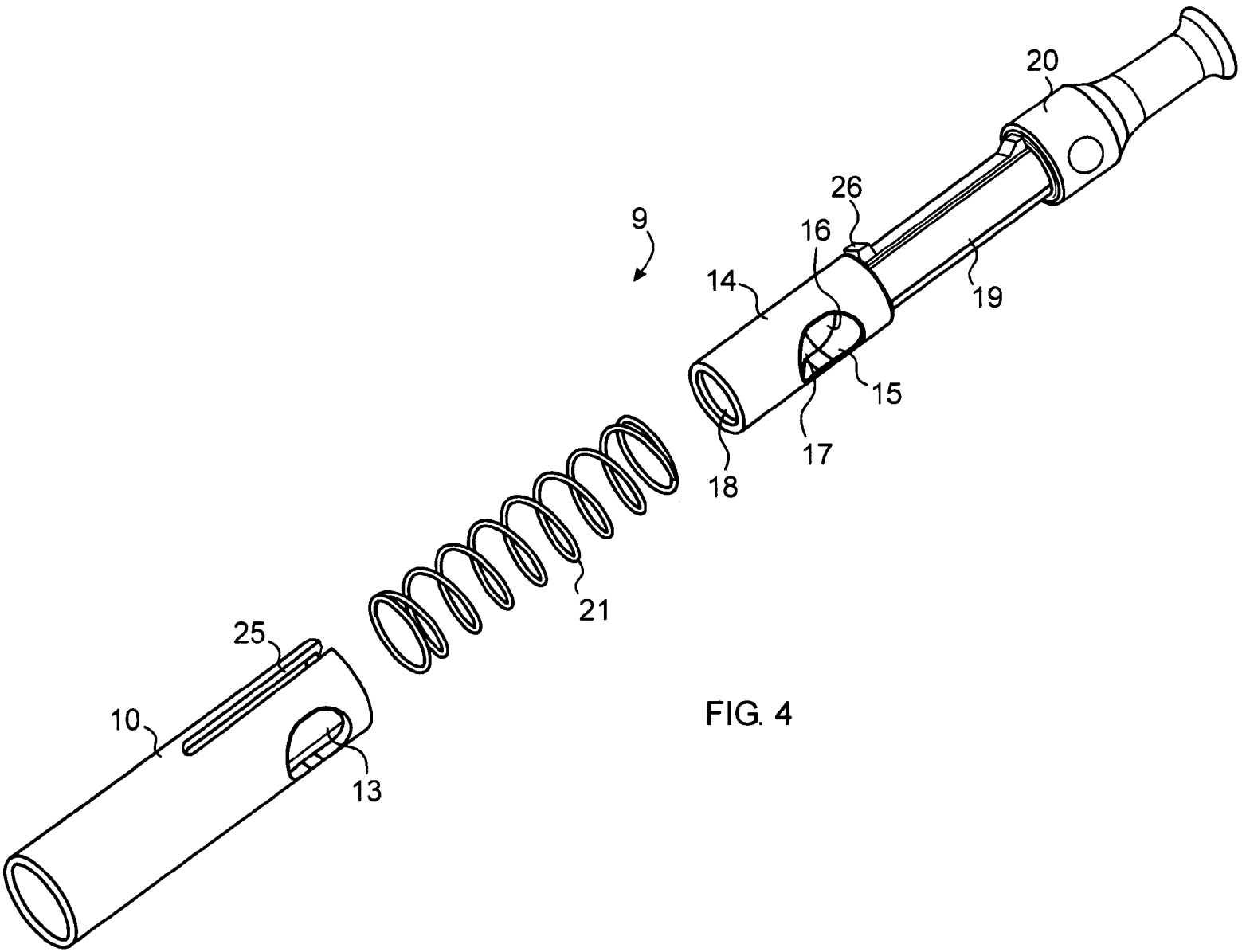
FIG. 4 is an exploded view of the bolt assembly.

As more specifically illustrated in FIGS. 2 and 3, the bolt assembly 9 comprises a sleeve 10 having an outer cross-section commensurate with the caliber of the gun barrel. The sleeve comprises a leading portion 11, and a trailing portion 12. The trailing portion has a radial aperture 13. A bolt 14 is engaged into the sleeve. The outer radius of the bolt is slidingly commensurate with the internal radius of the sleeve so that the sleeve can intimately slide over the bolt. A radial intake port 15 in a proximal section of the bolt leads to a gas discharge channel comprising a rounded elbow zone 16 and an axial channel zone 17 leading to an axial discharge port 18. An axle 19 projects rearwardly and axially from the proximal end of the bolt and is connected to a barrier block 20, a compression spring 21 engaged over the axle between the bolt and the barrier block biases the sleeve 10 into a firing position where the intake port 15 of the bolt and the aperture 13 of the sleeve are lined up.

As shown in FIG. 1, a strip pin 22 radially connects the barrier block 20 of the bolt to a trigger mechanism 23. The trigger mechanism can translate the bolt assembly 9 from a recoil position where the sleeve 10 clears the first port of the gun barrel to admit a projectile into the first portion 3 of the gun barrel, to a firing position where the first port is occluded by the sleeve while the sleeve aperture 13 and the intake port 15 line up with the second port 7 to admit gas into the channel of the bolt. Any projectile 24, whose radius is approximately commensurate with the inner radius of the sleeve and the outer radius of the bolt, is engaged by the sleeve then propelled down the barrel under the expansion of the gas coming through the bolt channel.

The pressure exerted by the gas expansion against the elbow zone 16 of the bolt channel helps the bolt assembly to recoil backward toward its initial position.

The spring 21 is stiff enough to maintain the alignment of the sleeve aperture 13 with the bolt intake port 15 during normal operation.

When the leading edge of the sleeve 10 contacts an obstacle such as a projectile that is only partially engaged through the first port 4, the sleeve slides back against the spring 21 toward the barrier block 20 causing a misalignment of of the aperture 13 and the intake port 15 as illustrated in FIG. 3. Accordingly, the gas admitting port 7 remains closed preventing gas from expanding into the bolt channel and firing or breaking the projectile.

An axial slot 25 in the trailing portion of the sleeve is engaged by a nib 26 projecting radially from the axle 19 in order to prevent rotational movement of the sleeve in relation to the bolt.

While the preferred embodiment of the invention has been described, modifications can be made and other embodiments may be devised without departing from the spirit of the invention and the scope of the appended claims.

What is claimed is:

1. A compressed-gas gun-firing mechanism which comprises a barrel having a distal portion and a proximal portion:

a cylindrical bolt in said proximal portion, said bolt having a given outer radius and a gas discharge channel extending from a radial intake port in a proximal section of the bolt to an axial discharge port at a distal end of the bolt;

said channel defining an axial zone and an elbow between said intake port and said axial zone;

whereby when said bolt is axially translated by a trigger mechanism said intake port lines up with a gas delivery port in the proximal portion of the barrel allowing compressed gas to enter said channel and apply recoiling pressure against said elbow, while, at the same time, applying firing pressure to a projectile located in said distal portion of the gum barrel; and, a sleeve slidingly inserted between said bolt and barrel and having a leading portion and a trailing portion;

said sleeve further having a radial aperture in said trailing portion;

resiliently compressible means between said bolt and said sleeve for biasing said leading portion ahead of said bolt and for keeping said intake port in line with said aperture;

said barrel further having a radial projectile-admitting first port in said distal portion and a radial gas-admitting second port in said proximal portion; and means for translating said bolt and sleeve from a recoiled position wherein said leading portion obstructs said gas delivery port, to a firing position wherein said gas delivery port, aperture, and intake port are aligned up to allow expansion of gas through said channel and into said barrel;

whereby a projectile partially inserted into said distal portion of the barrel causes said sleeve to resiliently slide over said barrel and said leading portion to close said intake port, thus preventing expansion of gas into said bolt and barrel.

2. The firing mechanism of claim 1 which further comprises:

means for feeding projectiles through said first port into said distal portion; and at least one spherical projectile having a radius commensurate with said given outer radius of the bolt.

3. The firing mechanism of claim 2, wherein said projectile comprises a ball having a soft, pliable envelope.

4. The firing mechanism of claim 3 which further comprises a source of compressed gas.

5. The firing mechanism of claim 4, wherein said compressed gas comprises air.

6. The firing mechanism of claim 5, wherein said bolt further comprises:

an axle extending axially and rearwardly from said bolt to a proximal end; and a barrier secured to said proximal end; and wherein said resiliently compressible means comprise a coil spring engaged over said axle between said sleeve and said barrier.

7. The firing mechanism of claim 6 which further comprises a strip pin radially linking said barrier to a trigger mechanism.

8. The firing mechanism of claim 1 which further comprises means for preventing rotational movement of said sleeve in relation to said bolt.

9. The firing mechanism of claim 8, wherein said means for preventing comprises said sleeve having an axial slot and said bolt having a radial nib engaged into said slot.

10. In a device for firing a projectile out of a barrel having a given cross-sectional caliber, by expansion of a compressed gas, wherein said projectile is radially admitted into said barrel through a first port located in a first portion of said barrel, and said compressed gas is radially admitted into said barrel through a second port located in a second portion of said barrel proximally located from said first portion, a firing mechanism for controlling admission of said gas, which comprises:

a tubular sleeve having an outer cross-section slidingly commensurate with said caliber, a given inner cross-section, a leading portion and a trailing portion;

said sleeve further having a radial aperture in said trailing portion;

a bolt engaged within said sleeve and having an outer cross-section slidingly commensurate with said inner cross-section;

a gas-discharged channel within said bolt extending from a radial intake port in a proximal section of said bolt to an axial discharge port at a distal end of said bolt;

said channel including an axial zone proximate to said discharge port and a rounded elbow zone between said intake port and said axial zone;

resiliently compressible means for biasing said leading portion of said sleeve ahead of said bolt and for keeping said intake port in line with said aperture;

means for translating said sleeve and bolt from a recoil position wherein said leading portion closes said second inlet, to a firing position wherein said second inlet, aperture and intake port are aligned to allow expansion of gas into said barrel;

whereby any obstacle in said first portion of the barrel, such as a projectile partially inserted through said first port, will cause sleeve to resiliently slide over said bolt and cause a misalignment of said aperture and intake port, preventing expansion of gas into said barrel.

* * * * *